US006142795A

United States Patent [19]

Kieninger et al.

[11] Patent Number: 6,142,795

[45] Date of Patent: Nov. 7, 2000

[54] ELECTRICAL CONNECTOR WITH GROUNDED CONTACT

[75] Inventors: Hans Kieninger, Stuttgart; Erich Straub, Weinstadt; Bernhard Rupp, Remseck, all of Germany

[73] Assignee: ITT Manufacturing Enterprises, Inc., Wilmington, Del.

[21] Appl. No.: 09/406,932

[22] Filed: Sep. 28, 1999

[30] Foreign Application Priority Data

Sep. 30, 1998 [DE] Germany ..... 198 44 829

[51] Int. Cl.[7] ..... H01R 4/66

[52] U.S. Cl. ..... 439/95

[58] Field of Search ..... 439/95, 91, 92, 439/101, 108, 607–610, 564–566, 570, 598, 595

[56] References Cited

U.S. PATENT DOCUMENTS

| | | | |
|---|---|---|---|
| 3,966,292 | 6/1976 | Schultz | 339/91 P |
| 4,572,600 | 2/1986 | Nieman | 339/14 R |
| 5,151,035 | 9/1992 | Kawai | 439/95 |

*Primary Examiner*—Paula Bradley
*Assistant Examiner*—Phuongchi Nguyen
*Attorney, Agent, or Firm*—Thomas L. Peterson

[57] ABSTRACT

A connector is provided with a contact that is grounded to a metal shell, which can be constructed at low cost. A grounded contact device (1A) that lies in a passage (10) of a connector housing, has a contact (20A) with a front mating end (3) and a rear terminating end (2) for connecting to a cable wire, the contact device also having a grounding element (9) in the form of a sleeve that lies around the contact and that can be inserted with the contact into the passage. The grounding element has a surrounding part (34) that closely surrounds a flange (8) on the contact, and has a rear portion with slots forming a plurality of tines (44) with a larger outside diameter than the surrounding part. When the contact device is inserted into the passage, the tines are compressed to squeeze the surrounding part of the grounding element tightly against the flange. The housing includes an insulator part (11) surrounded by a metal shell (52), the passage extending through the insulator part adjacent to its periphery (62), and with at least part of the passage having one side forming an opening (60) which is open to the shell. A portion (13) of the metal shel! lies in the opening and directly engages the grounding element of the contact device.

8 Claims, 3 Drawing Sheets

ELECTRICAL CONNECTOR WITH GROUNDED CONTACT

BACKGROUND OF THE INVENTION

Electrical connectors for supplying power to appliances and for other purposes, often must include one contact which is grounded to a metal shell, in addition to one or more contacts that are insulated from the shell. The grounded contact must have a low resistance connection to ground which can carry at least moderate current. Many grounded contact designs have been used in the past, but generally with considerable added cost for the grounded contact. A grounded contact which provided good connection to ground with minimal additional cost, would be of value.

SUMMARY OF THE INVENTION

In accordance with one embodiment of the present invention, an electrical connector apparatus is provided, which includes a connector housing with a passage and a contact device that lies in the passage, where the contact device is connected to a metal shell of the housing in a simple construction. The contact device includes a contact and a grounding element in the form of a sleeve. The sleeve has a front end that closely surrounds a flange on the contact, and has a multi-tine rear end of initially largely diameter, which can be compressed. The housing includes an insulator forming the passage, but with the passage having a sideward opening that opens to the surrounding metal shell. A part of the metal shell extends through the opening and directly contacts and compresses the grounding element.

The novel features of the invention are set forth with particularity in the appended claims. The invention will be best understood from the following description when read in conjunction with the accompanying claims.

DESCRIPTION OF THE PREFERRED EMBODIMENTS

Figure 1:
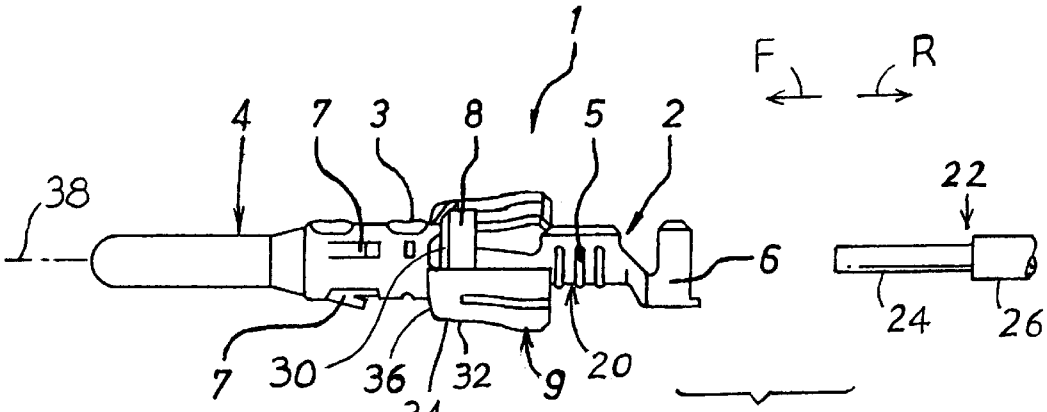
FIG. 1 is a side elevation view of a pin contact device, and also showing a stripped end of a cable that can connect to the contact device.
Figure 4:
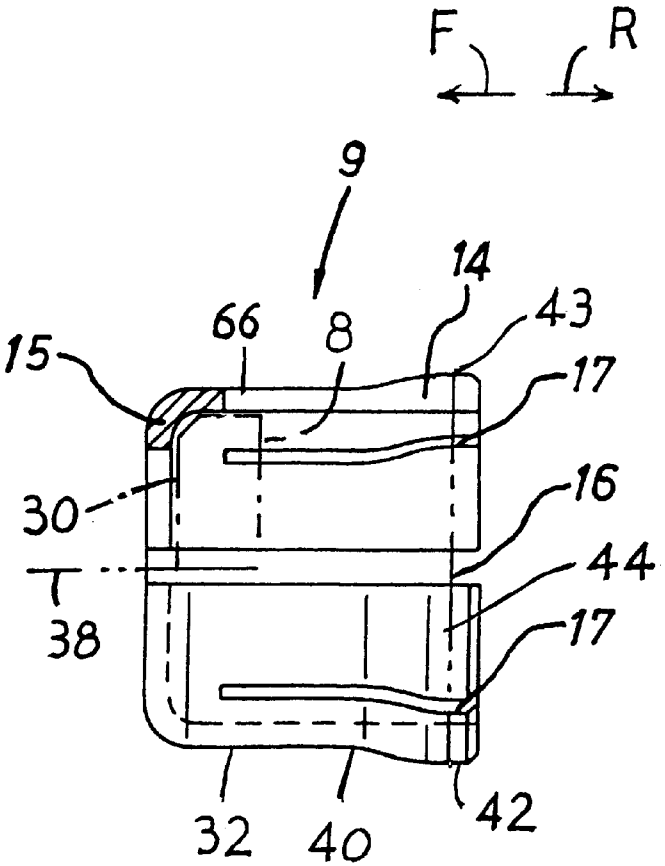
FIG. 4 is a partially sectional side view of the grounding element of FIG. 2.

FIG. 1 illustrates a pin contact device 1 which includes a contact 20 and a separate grounding element 9 that is mounted on the contact. The contact has a front mating end 4 in the form of a pin that can mate with a socket of a mating contact, and has a rear terminating end 2 for terminating to a cable 22. A bared wire 24 of the cable is inserted into a crimp terminal which is crimped around the wire, while any insulation 26 of the cable lies around another crimp terminal 6 and is crimped thereto. The contact has a flange 8 lying between its opposite ends, the flange having a front end 30. the grounding element 9 comprises a piece of sheet metal that has been rolled into a largely cylindrical shape. The grounding element has a front portion 32 with a surrounding part 34 that closely surrounds the flange 8, and with a front part 36 which is bent radially inwardly, towards the axis 38 of the contact, to engage the front end 30 of the flange. As shown in FIG. 4, the grounding element 9 has a rear portion 40 that extends rearwardly from the front portion 32 and that has a rear end 42 lying on an imaginary circle 43 of larger initial diameter than the front portion 32. The rear portion has a plurality of slots 17 that divide it into tines 44 with free rear ends at 42 that can be readily deflected radially inwardly. The grounding element 9 is formed from a piece of sheet metal that has been rolled into a largely cylindrical shape, and that has a slot 16 where opposite sides of the piece of sheet metal meet. The slot 16 has considerable width in the initial configuration of the grounding element, before it is installed on the contact as in FIG. 1.

Figure 2:
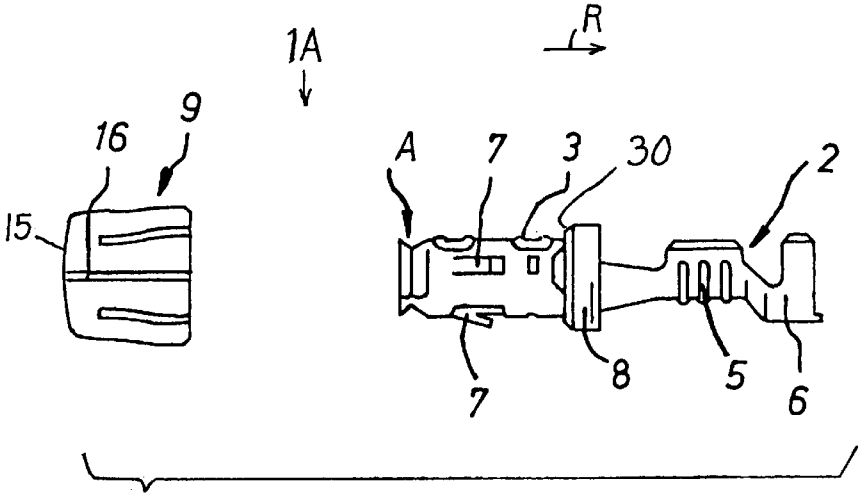
FIG. 2 is an exploded side elevation view of a socket contact device, including a socket contact and a grounding element.
Figure 2A:
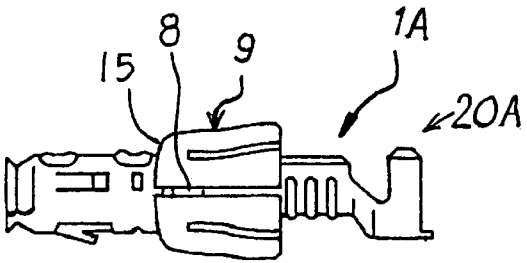
FIG. 2A is a side elevation view of the socket contact device of FIG. 1, shown in its fully assembled position prior to installation in a connector housing.

FIGS. 2 and 2A show a contact device 1A which is similar to the contact device of FIG. 1, except that the contact device of FIG. 2 has a mating end 4A that forms a socket for receiving a pin of a mating contact, such as the mating contact shown in FIG. 1. Otherwise, the contacts 20 and 20A of FIGS. 1 and 2 are the same.

Figure 3:
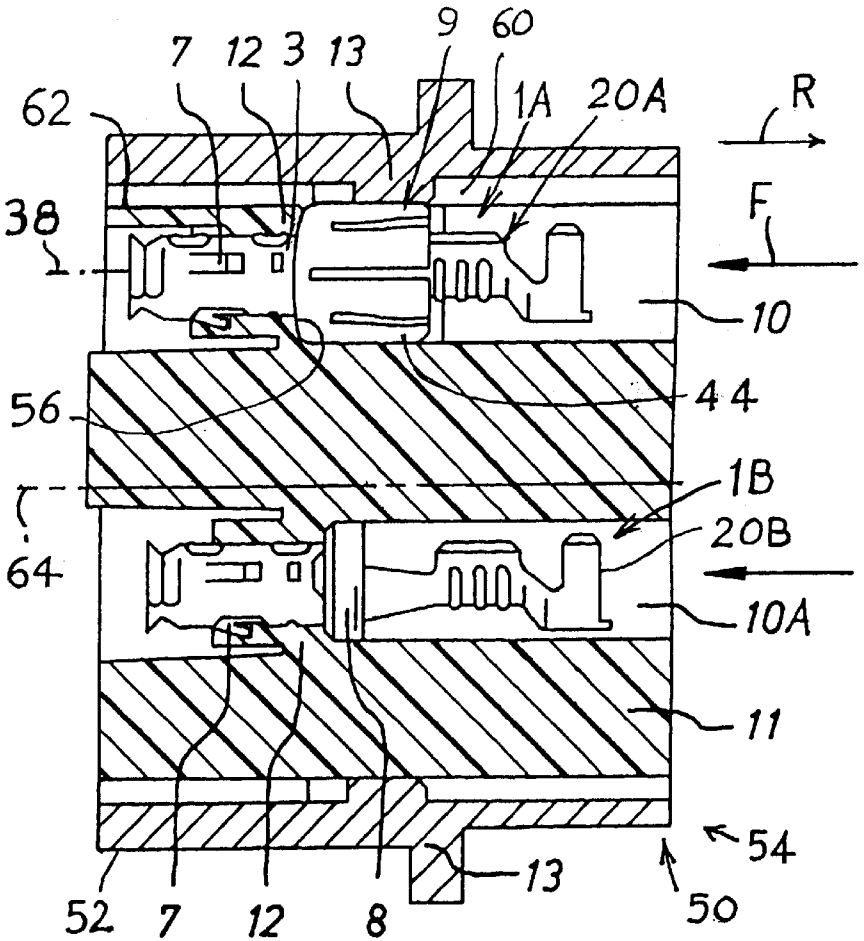
FIG. 3 is a sectional view of an electrical connector apparatus, including a connector housing, the socket contact device of FIG. 2A in one housing passage, and the contact shown in FIG. 2 in another passage.
Figure 3A:
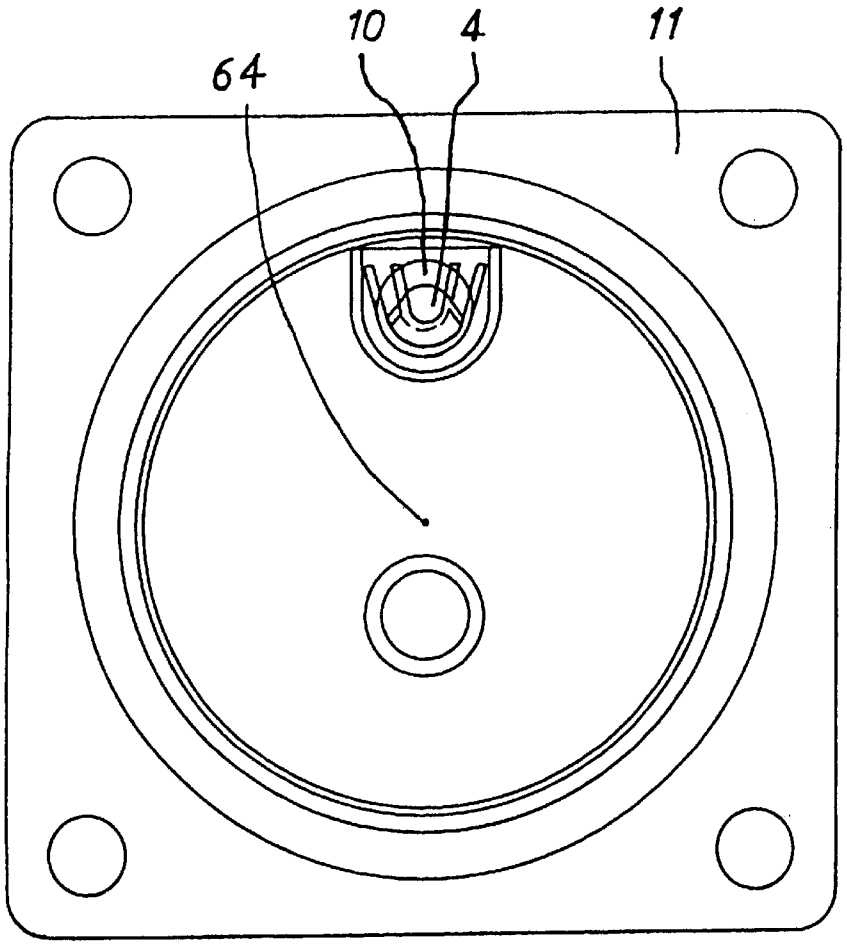
FIG. 3A is a left side view of the electrical connector apparatus of FIG. 3.
Figure 5:
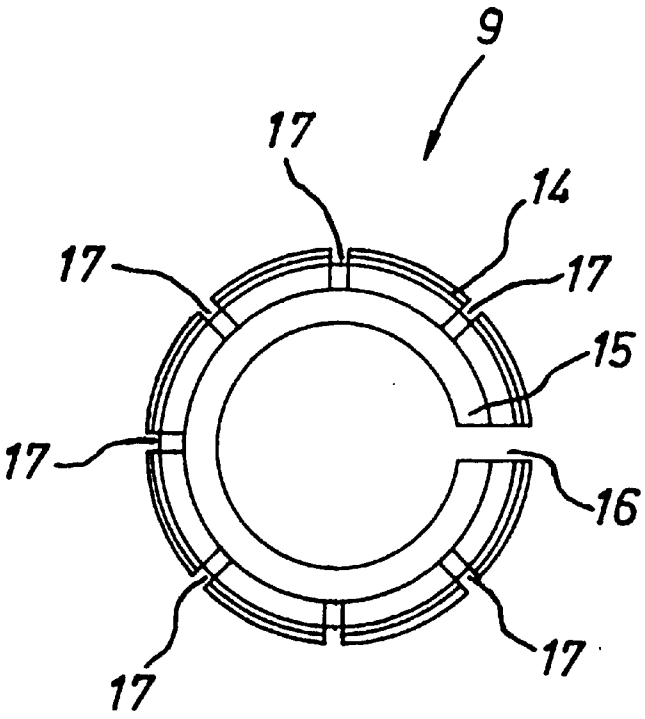
FIG. 5 is a rear view of the grounding element of FIG. 4.

FIG. 3 shows the contact device 1A installed in a passage 10 of a connector housing 50. The connector housing includes an insulator 11 with a plurality of passages 10, 10A and a metal shell 52 that surrounds the insulator and that is electrically grounded. The combination of the connector device 1A and any other connector device such as 1B within the housing 50, forms an electrical connector apparatus 54.

To assemble the electrical connector apparatus, the grounding element 9 of FIG. 2A is installed on the contact 20A, by moving the grounding element in a rearward direction R around the contact until the bent front end 15 of the grounding element abuts the front end 30 of the flange 8. Then, as shown in FIG. 3, the assembled contact device 1A is moved forwardly F into the passage 10 until the front end of the grounding element 9 engages a stop surface 56 formed along the passage. It can be seen in FIG. 3 that the passage 10 has a radial (with respect to axis 38) opening 60 that opens to the shell 52. The particular passage 10 lies near the periphery 62 of the insulator so that the opening 60 is not long. The uppermost tines 44 shown in FIG. 3 are accessible through the opening, to directly engage the metal shell 52. The metal shell is provided with a grounding wall 13 in the form of a flange that extends radially inwardly with respect to the axis 64 of the connector housing, to project through the opening 60 and directly engage the tines of the grounding device. In this way, the contact device 1A makes direct contact with the metal shell 52 of the housing, to provide wide area firm contact between the contact device and shell for secure grounding.

As shown in FIG. 4, when the grounding element 9 is initially installed, it fits closely around the flange 8 and abuts the flange front end 30. When the rear ends 42 of the tines are radially compressed towards the axis 38 of the contact device, the tines act like levers whose inner ends at 66 press firmly against the outside of the flange to make good electrical contact therewith. It is noted in FIG. 3 that the walls of the passage 10 also press the rear ends of the tines towards the axis 38 of the contact device. To prevent removal of the contact device in a rearward direction R, a middle portion 3 of the contact is provided with fingers 7 that engage largely forwardly-facing shoulder formed by the passage walls.

It is noted that the second contacting device 1B in the other passage 10A of the electrical connector apparatus, is not to be grounded, and does not have a ground element around its flange 8. This reduces the cost of manufacture, since the contacts 20A, 20B of the grounded contact device 1A and of the non-grounded contact device 1B are substantially the same, in that most or all of the manufacturing steps can be the same for both contacts. It is noted that some electrical connector apparatuses have three or more contact devices, although there is usually only a single grounded contact device.

Thus, the invention provides an electrical connector apparatus with a grounded contact device, which enables construction and assembly at low cost. The grounded contact device includes a contact element having a mating end and an opposite terminating end, and having a flange. The contact device also includes a grounding element in the form of a sleeve which has a front portion that closely surrounds the flange and a rear portion that can be radially deflected towards the axis of the contact device. A connector housing includes an insulator with a passage near its periphery and with an opening in the passage that leads to its periphery. The housing also includes a metal shell lying about the periphery of the insulator, with contact between the shell and grounding element occurring through the opening. The shell includes a radially inwardly-extending flange that projects into the opening and that helps compress the rear end of the grounding element, to thereby make contact with it and to compress a front portion of the grounding element tightly against the outside of the flange.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. Electrical connector apparatus comprising:

a connector housing which has front and rear ends and which has passage walls forming a passage extending between said ends, and that has an electrically conductive grounded wall forming a portion of the wall of said passage;

a contact device that has an axis, including a contact and a grounding element;

said contact having a front mating end and a rear terminating end, and said contact having a flange lying between said mating and terminating ends with said flange having a front end;

said grounding element comprises a piece of sheet metal in the form of a sleeve, with said grounding element having a front portion with a surrounding part that surrounds said flange and with a radially inwardly bent front part that lies against said flange front end, said grounding element having a rear portion that extends rearwardly from said front portion and that is resiliently radially inwardly deflectable toward said axis;

said contact device lies in said passage with said grounding element rear portion being radially inwardly compressed by said grounded wall.

2. The apparatus described in claim 1 wherein:

said grounding element rear portion has a plurality of axially-extending slots that divide said rear portion into a plurality of tines with free rear ends having outer surfaces lying on an imaginary circle of greater diameter than the outside diameter of said surrounding part of said front portion of said grounding element.

3. The apparatus described in claim 1 wherein:

said connector housing includes an insulator part with a periphery, and with said passage extending through said insulator at a location adjacent to said periphery, with part of said passage having one side forming an opening which is open at said periphery;

said connector housing includes a rigid metal shell that forms said grounded wall and that closely surrounds said insulator, with a portion of said rigid metal shell lying at said opening and being in contact with said grounding element front portion thereat.

4. The apparatus described in claim 3 wherein:

said insulator has an axis and said shell includes a cylindrical inside portion and a radially inwardly-projecting shell flange that projects through said opening in said periphery of said passage and that has a radially inner end that resiliently compresses said sleeve rear portion.

5. Electrical connector apparatus comprising:

a connector housing that has an axis and that includes an insulator with insulator front and rear ends and that also includes a metal shell that extends around said insulator, said insulator having a passage that extends between said insulator ends, with said passage having a radial opening that opens to said shell;

a contact device that lies in said passage, with said shell having a rigid part that is integral with the rest of said shell and that projects at least partially through said opening and that engages said contact device.

6. Electrical connect apparatus for installation in a connector housing, comprising:

a contact having an axis and having a front mating end, a rear terminating end for connection to a wire, and a flange having front and rear surfaces and lying between said ends;

a grounding element in the form of a piece of sheet metal that has been rolled into the shape of a sleeve with separated sides, said grounding element having a first portion with a surrounding part that closely surrounds said flange and that lies against said flange front surface and that lies spaced around said flange rear surface, and a second portion of greater outside diameter than said surrounding part, so when said second portion is radially compressed said surrounding portion is urged radially inwardly to tightly engage said flange.

7. The apparatus described in claim 5 including:

a connector housing that includes an insulator with insulator front and rear ends and a metal shell that extends closely around said insulator, said insulator having a passage that extends between said insulator ends, with said passage having an opening that opens, in a direction perpendicular to said axis, to said shell, with said contact and grounding element lying in said passage, and with said grounding element second portion and said shell engaging each other through said opening.

8. The apparatus described in claim 7 wherein:

said shell has a rigid part that projects through said opening and that compresses said second end portion of said ground element.

* * * * *